United States Patent [19]

Henry

[11] 4,396,237

[45] Aug. 2, 1983

[54] PACKAGE DISPLAYING DISPENSER

[76] Inventor: Joseph D. Henry, 470 Barston, Covina, Calif. 91724

[21] Appl. No.: 240,555

[22] Filed: Mar. 4, 1981

[51] Int. Cl.[3] ..... A47F 1/00; A47F 3/02

[52] U.S. Cl. ..... 312/42; 312/50; 312/60; 312/107; 211/49 D

[58] Field of Search ..... 312/42, 50, 60, 35, 312/293, 107, 274; 211/49 D; 221/133, 281

[56] References Cited

U.S. PATENT DOCUMENTS

| | | | |
|---|---|---|---|
| 1,020,557 | 3/1912 | Hunter | 312/107 |
| 1,668,171 | 5/1928 | Pratt | 312/42 |
| 1,673,812 | 6/1928 | Dunn | 312/42 |
| 2,723,036 | 11/1955 | Temple | 312/42 |
| 3,287,073 | 11/1966 | Holtkamp | 211/49 D |
| 3,674,175 | 7/1972 | Jaquish | 312/42 |
| 3,744,866 | 7/1973 | Cook | 312/42 |
| 3,993,196 | 11/1976 | Immordino | 211/49 D |
| 4,037,756 | 7/1977 | Jaquish | 312/42 |
| 4,227,758 | 10/1980 | Clare | 312/107 |
| 4,305,628 | 12/1981 | Glasener | 312/42 |

FOREIGN PATENT DOCUMENTS

| | | | |
|---|---|---|---|
| 221791 | 11/1957 | Australia | 312/42 |
| 1008140 | 5/1952 | France | 312/42 |

*Primary Examiner*—Victor N. Sakran
*Attorney, Agent, or Firm*—Eric P. Schellin

[57] ABSTRACT

A cabinet for displaying and dispensing vertical stacks of small packages, such as packs of cigarettes, is adapted to be mounted over a store's check-out counter. The shopper's side of the package displaying dispenser is transparent, so that the shopper can see the merchandise. The clerk's side of the package displaying dispenser has an upper opening which permits loading of packages onto the stacks and a lower slot which permits the clerk to withdraw one package at a time from the bottom of any selected stack. A similar package displaying dispenser is mounted on the rear side of the one just described, so that the packages in the rear one can be seen through the one in front, and so that the clerk can withdraw packages from both.

4 Claims, 7 Drawing Figures

PACKAGE DISPLAYING DISPENSER

CROSS REFERENCE TO RELATED APPLICATIONS

There is no related application.

SUMMARY AND BACKGROUND OF INVENTION

Modern merchandising is designed to foster impulse buying by displaying goods for sale in an attractive manner so as to catch the eye of the shopper and appeal to his desires. A shopper waiting at a counter for service is especially susceptible to an attractive display, since he is merely waiting, as in a check-out line.

The package displaying dispenser of the present application is designed for use above a counter, such as a check-out counter, in such a way that it is close to and readily seen by the waiting shopper, but high enough over the counter so that the counter top itself is unobstructed. Thus, the shopper can see the display and also put down on the counter top anything he is carrying, such as his selection of merchandise.

The package displaying dispenser is in the shape of a rectangular prism. One of its major faces is transparent so that the stacked packages within, which may be cigarette packs, can be seen by the shopper. He can, however, not remove a package because the said major face has no openings. The opposite major face, which is on the clerk's side of the counter, is open at the top so that the display can be loaded with additional packages, and also has a long slot opening at the bottom so that the clerk can remove packages. The first-in, first-out dispensing results in a desirable rotation of the stock, not had when loading and removal are from the top of a stack.

There are so many different brands of cigarettes on the market and smoker's tastes are so varied, that, in order to satisfy 95 percent of all customers, almost a hundred different brands should be stocked. This requires the package displaying dispenser to extend for a considerable length along the counter, about 20 feet for 100 stacks of cigarettes. In accordance with one of the features of our invention, this length can be cut in half by piggy-backing an additional package displaying dispenser behind the one in front. The additional one is visible through the one in front, so that the shopper sees a second set of packages stacked behind the ones in front.

In this arrangement, labels in the form of advertising placards can be posted at the bottom of the front package displaying dispenser to indicate the nature of the adjacent stacks of packages in the front and rear.

THE DRAWINGS

DETAILED DESCRIPTION

Figure 1:
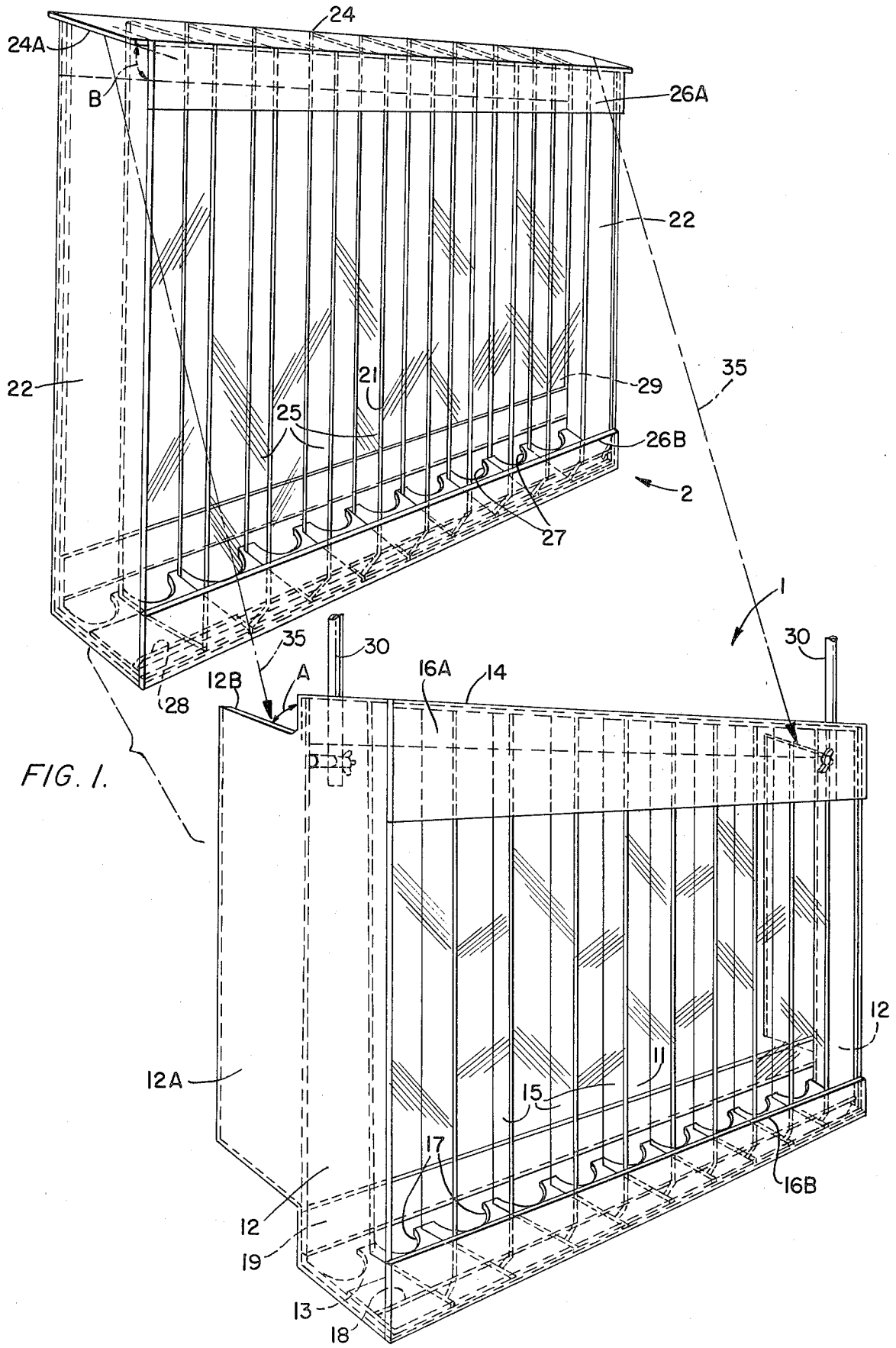
FIG. 1 is an exploded perspective view of a piggy-back combination of a front package displaying dispenser and a rear package displaying dispenser, showing how the rear is hung on the front.

Referring to FIG. 1, 1 is the front package displaying dispenser while 2 is the rear package displaying dispenser. Dispenser 1 has a major front side in the form of a transparent window 11, made of a material such as acrylic resin, so as to be light in weight. The window 11 permits viewing into the box defined by sides 12, bottom 13 and top 14.

The inside of dispenser 1 is divided into 10 vertical stack ways by means of 9 vertical partitions 15.

The partitions 15 are spaced at such distance as to accomodate vertical stacks of standard sized packages, such as cigarette packs.

Framing members 16A and 16B reinforce the top and bottom of the window area.

The bottom 13 has a cut-out 17 adjacent the lower end of each of the vertical stacks of packages. A camming piece 18 slanted at a 45 degree angle is provided to cam or push rearwardly the lowermost package of a stack. The packages above the lowermost one do not follow the lowermost one to the rear, when the lowermost one is cammed to the rear, because the second package from the bottom is restrained from moving to the rear by a blocking bar 19.

Since the bottom package of each vertical stack projects to the rear, the clerk can readily grasp the bottom package and extract it completely from the package displaying dispenser 1. The presence of cutouts 17 facilitates such removal.

The partitions 15 are preferably transparent, while all the other parts, except for transparent window 11, can be opaque. With such a mix of transparent and opaque members, the packages are displayed in a framed setting which does not obstruct viewing. However, if it is desired to place placards on the shopper's side to advertise the varieties of packages on display, the framing member 16B can be made transparent and the placards can be placed behind framing member 16B.

A pair of support members 30 suspend the package displaying dispenser 1 from the overhead; over a counter, for example.

The dispenser 1, as described thus far, is useful for selling a limited range of stock. In the particular embodiment described, a maximum of 10 varieties of packages could be accomodated, if each variety had exclusive use of a stack way.

By providing a pair of wings **12*a*, it is possible to hang an additional or rear package displaying dispenser 2 on the lands 12*b* of wings 12*a*, as shown by the two arrows 35. The rear package displaying dispenser 2 is visible to the shopper through the window 11 of the front one. Thus, in the same length of counter space, 20** varieties of packages could be accomodated.

The rear package displaying dispenser 2 has a slanted top 24. The slant is shown by the angle B, which is somewhat greater than 90 degrees. The projecting end 24A hangs on the land 12B which is slanted so that the angle A between land 12B and the vertical edge is somewhat less than 90 degrees. As a result, the rear package displaying dispenser has a tendency to slide down the slanted land 12B so as to bear tightly against the front package displaying dispenser 1. The angles B and A should be supplementary. For example, angle B may be 100 degrees, in which case angle A would be 80 degrees.

The construction of rear package displaying dispenser 2 is similar to that of the front package displaying dispenser 1 and similar reference numerals, but one decade larger, are used for parts of the rear one corresponding to parts of the front one.

Figure 2:
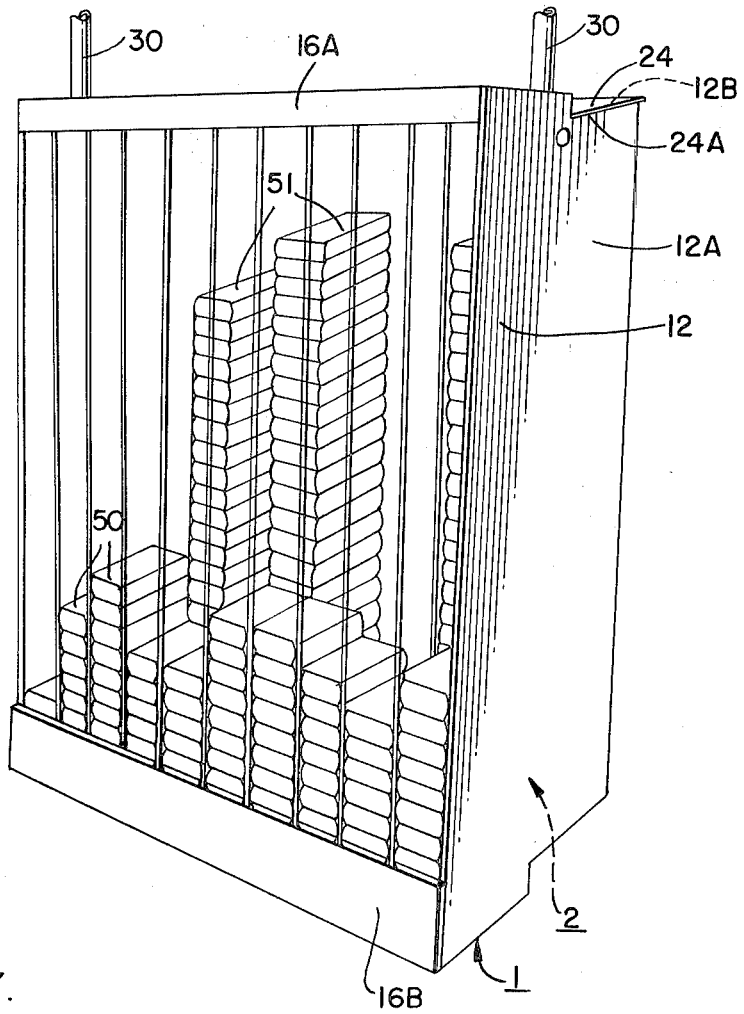
FIG. 2 is a front perspective view of the piggy-back combination, as assembled, and shows the side seen by the shopper.

In FIG. 2 the front and rear package displaying dispensers are shown assembled, as seen from the viewpoint of the shopper. The taller stacks of packages 51 in rear dispenser 2 are seen behind the lower stacks of packages 50 in front dispenser 1.

Figure 3:
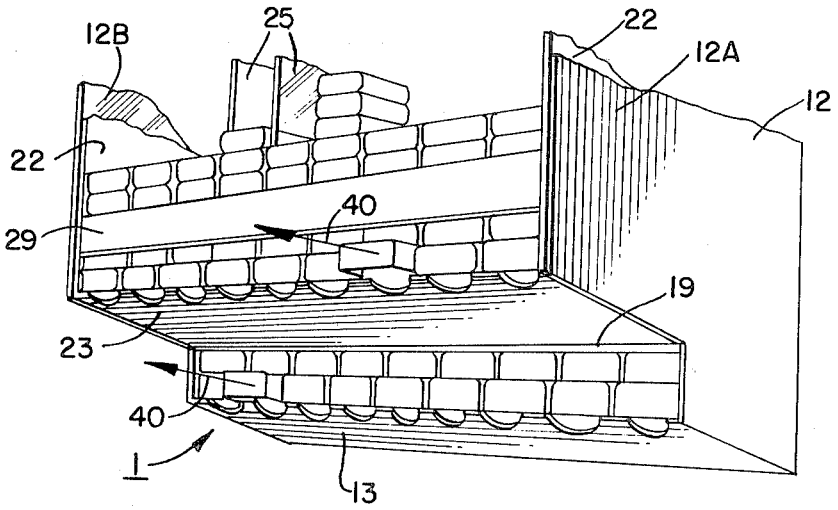
FIG. 3 is a rear perspective view of the piggy-back combination, as assembled, and illustrates how packages are withdrawn from the front and rear package displaying dispensers.

FIG. 3 shows a rear view, opposite to that seen in FIG. 2. It is seen that the clerk can readily withdraw packages from any desired stack in either rear dispenser 2 or front dispenser 1, as shown by the two partially withdrawn packages and the arrows 40. In FIG. 3, in order to avoid confusion, only two of the transparent partitions 25 of the rear dispenser have been indicated, and none of the transparent partitions 15 of the front dispenser 1 have been shown.

In order to load the rear dispenser 2, all that is necessary is to stack the refill packages in the stack ways. The rear dispenser 2 is therefore advisably used for rapid moving varieties.

To load the front dispenser 1, the rear dispenser 2 is first lifted off and put aside, whereupon the front dispenser 1 is loaded. It is therefore advisable to use the front dispenser 1 for slower moving varieties. These need not, furthermore, be piled up high, thereby permitting a view, to the shopper, of the more highly piled stacks in the rear dispenser 2.

Figure 7:
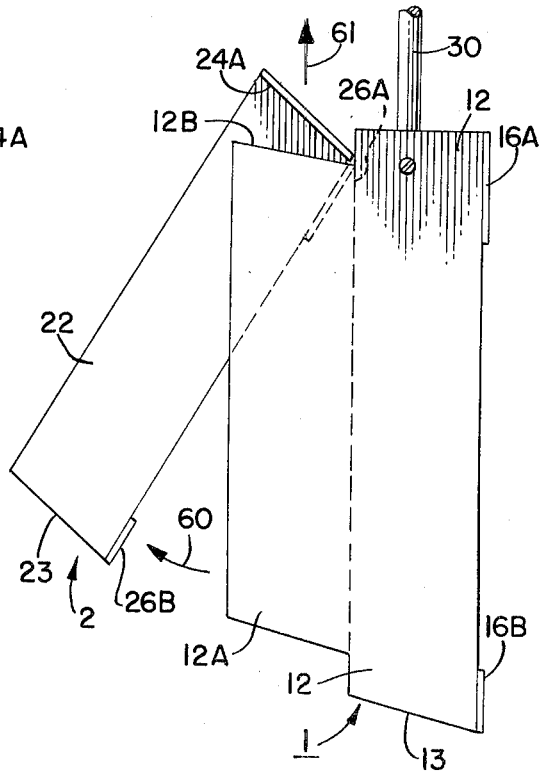
FIG. 7 is a view illustrating one procedure for lifting the rear package displaying dispenser from its support on the front package displaying dispenser.

FIG. 7 illustrates one possible procedure for lifting the rear package displaying dispenser 2 from its support on the lands 12B of front package displaying dispenser 1. First the rear dispenser 2 is swung back, as shown by the arrow 60, whereupon the rear dispenser 2 is lifted off the land 12B, as shown by arrow 61.

Figure 5:
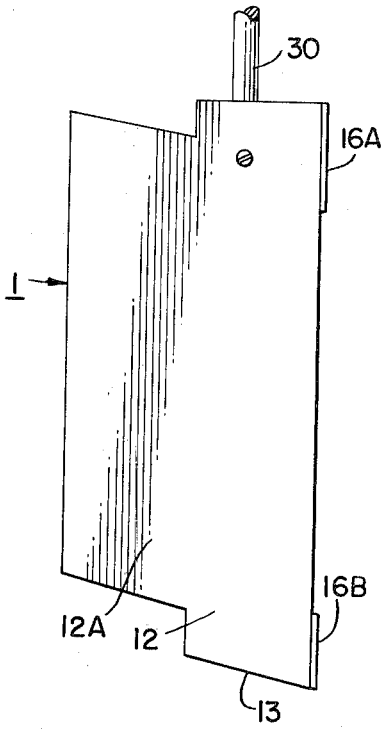
FIG. 5 is a side view of the front package displaying dispenser, taken from that side which is on the shopper's left.

The side view of FIG. 5 illustrates an element of design of the invention, which permits the packages to be stably stacked in the stack ways, even though the packages are restrained on only two sides by the partitions 15—15 (or 25—25) and only on a third side by the window 11 (or 22). On the fourth side the packages are unrestrained, because the fourth side of the stack ways are open to permit loading of the packages into the stack ways. Nonetheless, the stacks of packages 50 or 51 will not tumble out of the said open side because all packages lie on a small slant, parallel to the slanted bottom 13 (or 23). This slant causes the packages to slide forward and bear against the window 11 (or 21).

Figure 4:
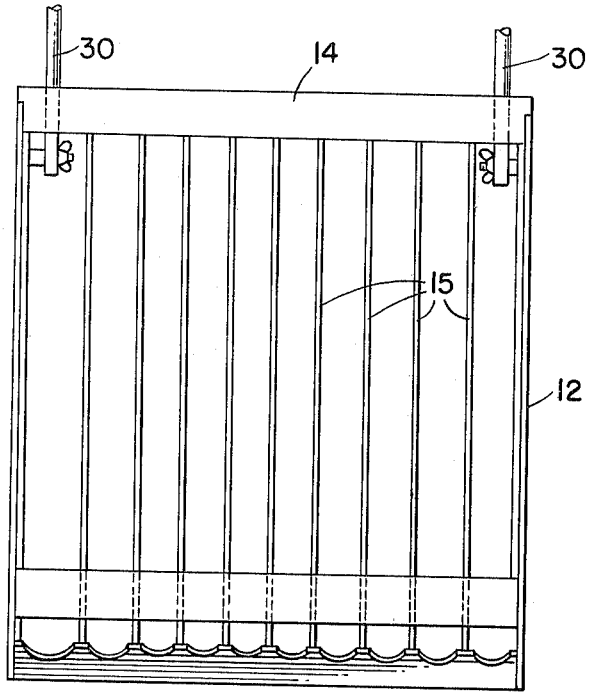
FIG. 4 is a rear view of the front package displaying dispenser.
Figure 6:
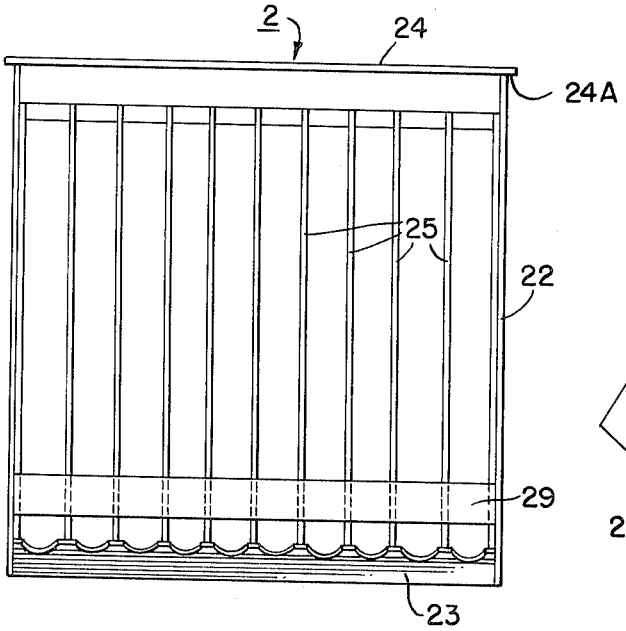
FIG. 6 is a rear view of the rear package displaying dispenser.

As seen in each of FIGS. 4 and 6, the partitions 15 and 25 need not be uniformly spaced. In the instance of where the packages are cigarette packages, it is to be noted that some varieties come in a soft-pack which must be torn open while others come in a cardboard box having an openable lid. These various cigarette packages are of differing sizes and the space given to the various stack ways therefore also differs.

I claim:

1. In combination:

a front package displaying dispenser;

a rear package displaying dispenser;

each of said package displaying dispensers having:

a transparent front in the form of a vertically situated window surrounded by a frame, said frame comprising two ends, a top and a bottom;

said frame extending rearwardly of said transparent front to define, with said window, the front to rear depth of the respective package displaying dispenser;

the rear portion of said frame being substantially open and unobstructed;

a plurality of spaced vertical partitions situated perpendicularly to the plane of said window, thereby dividing the space behind said window into a plurality of vertically disposed channels, adapted for vertical stacking of packages in said vertically disposed channels;

each of the said ends of said front package displaying dispenser having wings which project rearwardly in the plane of the respective ends;

means on said wings for supporting the transparent front of said rear package displaying dispenser against the substantially open rear of said front package displaying dispenser;

whereby said two dispensers display their respective stacks of packages in one row behinder another row, said one row being visible through two windows and said another row being visible through one window.

2. The combination according to claim 1 in which:

said means for supporting said rear package displaying dispenser includes:

slanted lands on the upper edges of said wings;

hanging means attached to said rear package displaying dispenser;

said lands acting as support surfaces for said hanging means, to thereby bear the weight of said rear package displaying dispenser;

the slant of said lands being in such sense as to tend to cause said hanging means to slide down said slanted lands towards said front package displaying dispenser.

3. The combination according to claim 1 wherein:

the said bottom of said frame is slightly tilted from the horizontal in such a direction as to tend to cause the packages in the stacks to slide towards the associated window, whereby the vertical stacks of packages are statically stable and will not tumble out of their respective stack ways.

4. The combination according to claim 1 having:

a camming member, situated at the bottom of each stack way, to urge the lowermost one of the stacked packages in a rearward direction, a blocking bar situated at the rear of each stack way, at a level above the said lowermost package but in blocking relationship to the package immediately above, whereby the lowermost package is cammed to the rear but the package immediately above is prevented from following said lowermost package to the rear, whereby the lowermost package projects to the rear of the other packages in said stack, to thereby facilitate grasping and removal of said lowermost package from its stack.

* * * * *